US011699863B2

(12) United States Patent
Hashiguchi

(10) Patent No.: US 11,699,863 B2
(45) Date of Patent: Jul. 11, 2023

(54) CONNECTOR AND ASSEMBLY

(71) Applicant: Japan Aviation Electronics Industry, Limited, Tokyo (JP)

(72) Inventor: Osamu Hashiguchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 15 days.

(21) Appl. No.: 17/569,611

(22) Filed: Jan. 6, 2022

(65) Prior Publication Data

US 2022/0271445 A1 Aug. 25, 2022

(30) Foreign Application Priority Data

Feb. 24, 2021 (JP) ..... 2021-027188

(51) Int. Cl.
*H01R 4/24* (2018.01)
*H01R 4/2433* (2018.01)
*H01R 12/51* (2011.01)

(52) U.S. Cl.
CPC ..... *H01R 4/2433* (2013.01); *H01R 12/515* (2013.01)

(58) Field of Classification Search
CPC .. H01R 4/2433; H01R 4/2429; H01R 4/2466; H01R 9/0757; H01R 12/515
See application file for complete search history.

(56) References Cited

U.S. PATENT DOCUMENTS 5,727,962 A * 3/1998 Caveney ..... H01R 13/6463 439/344
5,782,651 A * 7/1998 Konoya ..... H01R 4/2429 439/949
6,120,319 A * 9/2000 Lee ..... H01R 12/675 439/497
6,544,067 B2 * 4/2003 Hagmann ..... H01R 4/2429 439/404
8,851,919 B2 * 10/2014 Schutz ..... H01R 4/2433 439/405

FOREIGN PATENT DOCUMENTS

| | | | |
|---|---|---|---|
| JP | 2602246 | Y2 | 1/2000 |
| JP | 2004-172072 | A | 6/2004 |
| JP | 2004-172073 | A | 6/2004 |
| JP | 2005-332734 | A | 12/2005 |
| JP | 2013-097955 | A | 5/2013 |

* cited by examiner

*Primary Examiner* — Phuong Chi Thi Nguyen
(74) *Attorney, Agent, or Firm* — Collard & Roe, P.C.

(57) ABSTRACT

A connector, with which an electrical wire is attachable, is connectable with a mating connector which has a mating contact portion. The connector comprises a housing and at least one terminal. The housing is provided with a support. The support has a receiving portion. The receiving portion is configured to receive a part of the electrical wire. The at least one terminal has an insulation displacement connection (IDC) portion, a contact portion, a supporting portion and a coupling portion. The IDC portion is configured to be insulation-displacement connected with the electrical wire. The support is positioned between the IDC portion and the supporting portion in a first predetermined direction. The coupling portion couples the IDC portion and the supporting portion with each other. The coupling portion has a neighboring portion. The neighboring portion neighbors to the support in a second predetermined direction perpendicular to the first predetermined direction.

13 Claims, 11 Drawing Sheets

CONNECTOR AND ASSEMBLY

CROSS REFERENCE TO RELATED APPLICATIONS

This application is based on and claims priority under 35 U.S.C. § 119 to Japanese Patent Application No. JP2021-027188 filed Feb. 24, 2021, the contents of which are incorporated herein in their entirety by reference.

BACKGROUND OF THE INVENTION

This invention relates to a connector with which an electrical wire is attachable.

Referring to FIGS. 18 and 19, JPU 2602246 (Patent Document 1) discloses a connector 900 of this type. Electrical wires 950 are attached with the connector 900. The connector 900 comprises a housing 910 and terminals 920. The housing 910 holds the terminals 920. The housing 910 is provided with supports 912. Each of the supports 912 has a receiving portion 9122 and a guide surface 9124. The receiving portion 9122 receives a part of the electrical wire 950. Each of the terminals 920 has an insulation displacement connection (IDC) portion 922 and a contact portion 924. The IDC portion 922 is insulation-displacement connected with the electrical wire 950. The contact portion 924 is brought into contact with a mating contact portion (not shown) when the connector 900 is connected with a mating connector (not shown).

A connector, which comprises a terminal having an IDC portion, such as the connector 900 of Patent Document 1 is required to have a reduced size in a direction in which an electrical wire starts to extend from the IDC portion.

SUMMARY OF THE INVENTION

It is therefore an object of the present invention to provide a connector which comprises a terminal having an IDC portion and which has a reduced size in a direction in which an electrical wire starts to extend from the IDC portion.

One aspect of the present invention provides a connector with which an electrical wire is attachable. The connector being connectable with a mating connector which has a mating contact portion. The connector comprises a housing and at least one terminal. The housing holds the at least one terminal. The housing is provided with a support. The support has a receiving portion. The receiving portion is configured to receive a part of the electrical wire. The at least one terminal has an insulation displacement connection (IDC) portion, a contact portion, a supporting portion and a coupling portion. The IDC portion is configured to be insulation-displacement connected with the electrical wire. The contact portion is brought into contact with the mating contact portion when the connector is connected with the mating connector. The supporting portion supports the contact portion. The support is positioned between the IDC portion and the supporting portion in a first predetermined direction. The coupling portion couples the IDC portion and the supporting portion with each other. The coupling portion has a neighboring portion. The neighboring portion neighbors to the support in a second predetermined direction perpendicular to the first predetermined direction.

The connector of the present invention is configured so that the support is positioned between the IDC portion and the supporting portion, which supports the contact portion, in the first predetermined direction. In other words, as compared with the connector 900 of Patent Document 1, mutual positions of the support, the IDC portion and the contact portion are modified in the connector of the present invention. This enables the connector of the present invention to have a reduced size in a direction in which an electrical wire starts to extend from the IDC portion.

An appreciation of the objectives of the present invention and a more complete understanding of its structure may be had by studying the following description of the preferred embodiment and by referring to the accompanying drawings.

Figure 1:
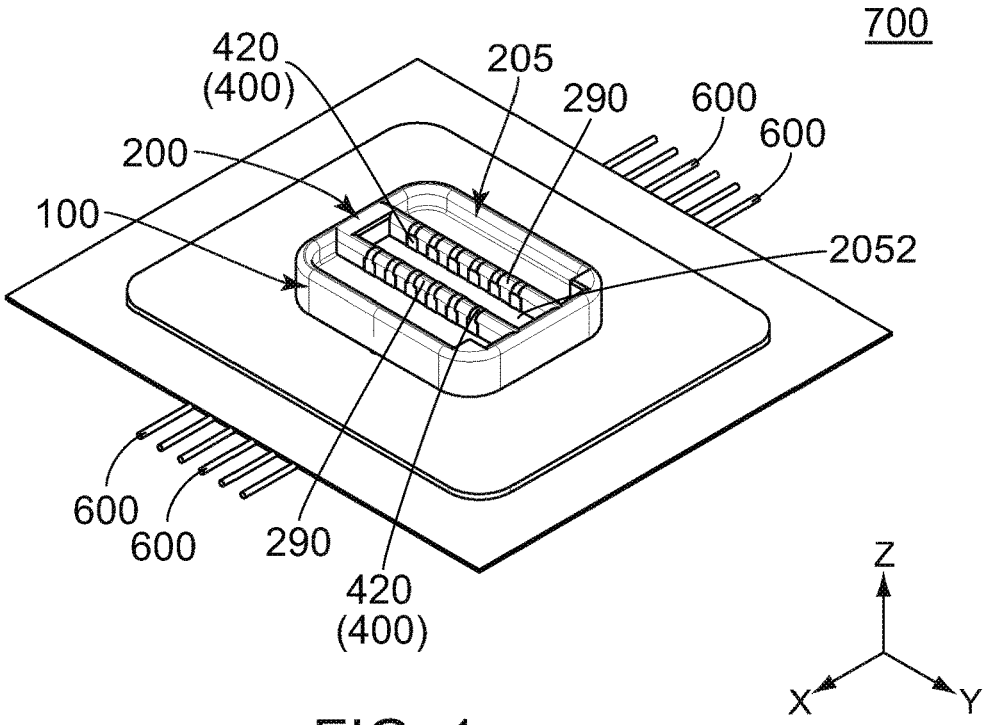
FIG. 1 is a perspective view showing an assembly according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

Figure 7:
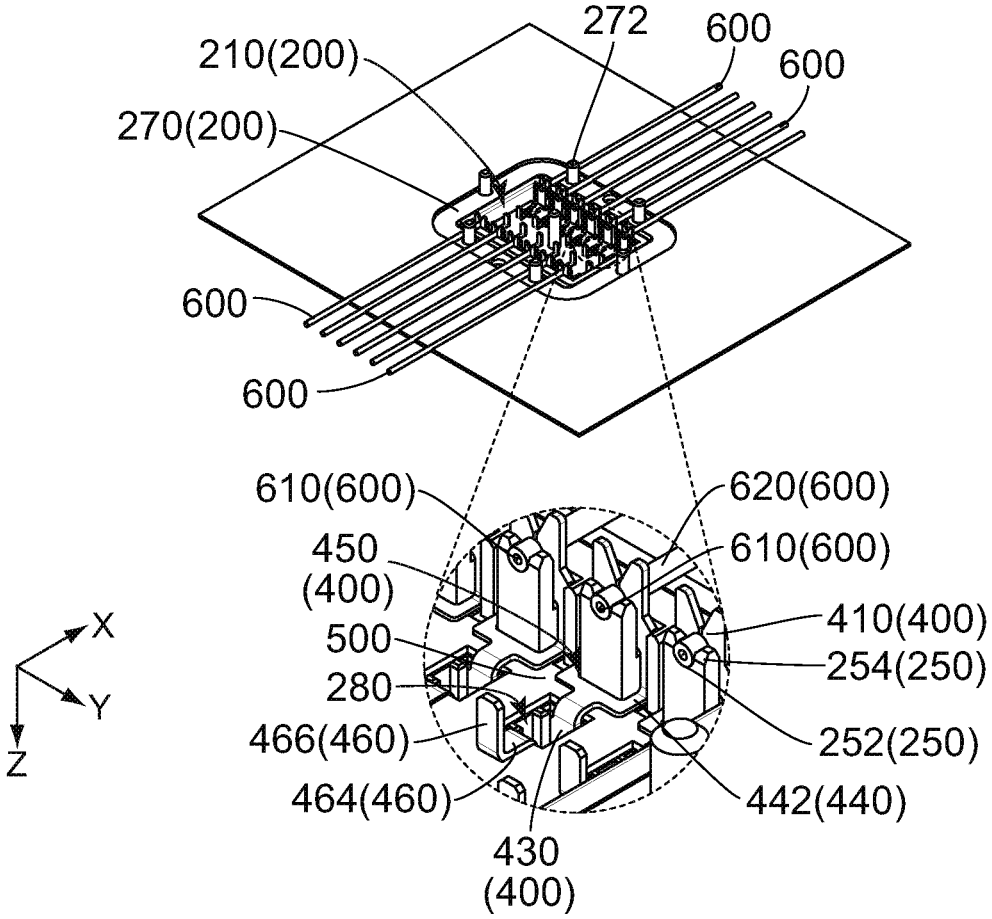
FIG. 7 is a perspective view showing a structure of a connector included in the assembly of FIG. 1, excluding an additional housing.

As shown in FIG. 1, an assembly 700 according to an embodiment of the present invention comprises a connector 100 and electrical wires 600. Each of the electrical wires 600 of the present embodiment extends in a first predetermined direction. In the present embodiment, the first predetermined direction is an X-direction. In addition, the first predetermined direction is also referred to as a front-rear direction. Specifically, it is assumed that forward is a positive X-direction while rearward is a negative X-direction. As shown in FIG. 7, each of the electrical wires 600 has a core wire 610 and an outer cover 620.

As shown in FIG. 7, the electrical wires 600 are attachable with the connector 100 of the present embodiment. Referring to FIG. 1, the connector 100 is connectable with a mating connector (not shown) which has mating contact portions (not shown). More specifically, the connector 100 is connectable along a perpendicular direction with the mating connector which has the mating contact portions. In other words, the perpendicular direction is a direction in which the connector 100 is connected with the mating connector. In the present embodiment, the perpendicular direction is a Z-direction. In addition, the perpendicular direction is also referred to as an up-down direction. Specifically, it is assumed that upward is a positive Z-direction while downward is a negative Z-direction.

As shown in FIG. 1, the connector 100 comprises a housing 200 and a plurality of terminals 400. However, the present invention is not limited thereto. Specifically, the number of the terminal 400 should be one or more. In other words, the connector 100 should comprise the housing 200 and at least one terminal 400.

Figure 2:
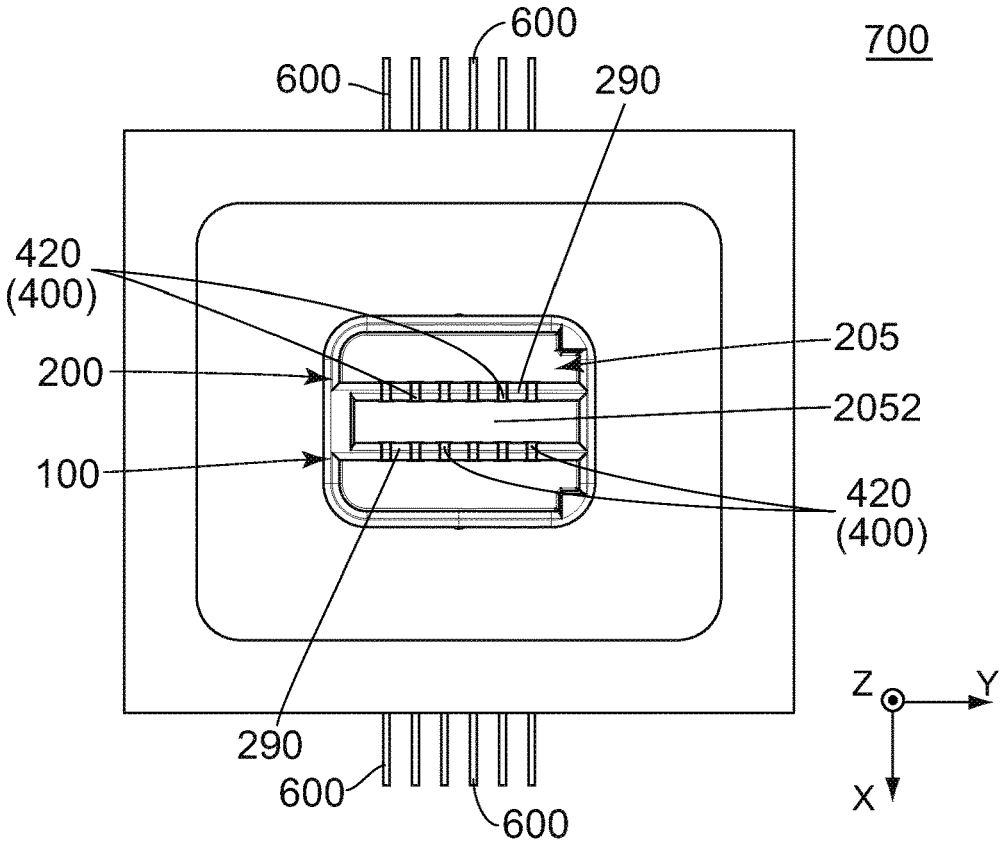
FIG. 2 is a top view showing the assembly of FIG. 1.

Referring to FIG. 2, the housing 200 of the present embodiment is made of resin. The housing 200 holds the terminals 400.

As shown in FIGS. 1 and 7, the housing 200 is provided with a mating connector accommodating portion 205, a plurality of supports 250, a plurality of terminal holding holes 280 and a plurality of island-like portions 290.

Referring to FIG. 1, the mating connector accommodating portion 205 of the present embodiment accommodates a part of the mating connector when the connector 100 is connected with the mating connector. The mating connector accommodating portion 205 is recessed inward in the perpendicular direction. Specifically, the mating connector accommodating portion 205 is recessed downward in the up-down direction. The mating connector accommodating portion 205 has a bottom surface 2052. The bottom surface 2052 defines an inner end of the mating connector accommodating portion 205 in the perpendicular direction. Specifically, the bottom surface 2052 defines a lower end of the mating connector accommodating portion 205 in the up-down direction.

As shown in FIG. 7, each of the supports 250 of the present embodiment extends outward in the perpendicular direction. Specifically, each of the supports 250 extends downward in the up-down direction. The supports 250 are arranged in two rows in the first predetermined direction. The supports 250 of each row are arranged in a second predetermined direction. In the predetermined embodiment, the second predetermined direction is a Y-direction.

As shown in FIG. 7, each of the supports 250 has a receiving portion 252 and a guide surface 254.

As shown in FIG. 7, the receiving portion 252 of the present embodiment is configured to receive a part of the electrical wire 600. The receiving portion 252 is positioned around a lower end of the support 250. When the receiving portion 252 is viewed in the first predetermined direction, the receiving portion 252 has a semicircular arc shape which is recessed upward.

As shown in FIG. 7, the guide surface 254 of the present embodiment is positioned at the lower end of the support 250. The guide surface 254 intersects with the first predetermined direction. In detail, the guide surface 254 is inclined outward in the perpendicular direction and outward in the first predetermined direction. Specifically, the guide surface 254 is inclined downward in the up-down direction and outward in the first predetermined direction.

Figure 8:
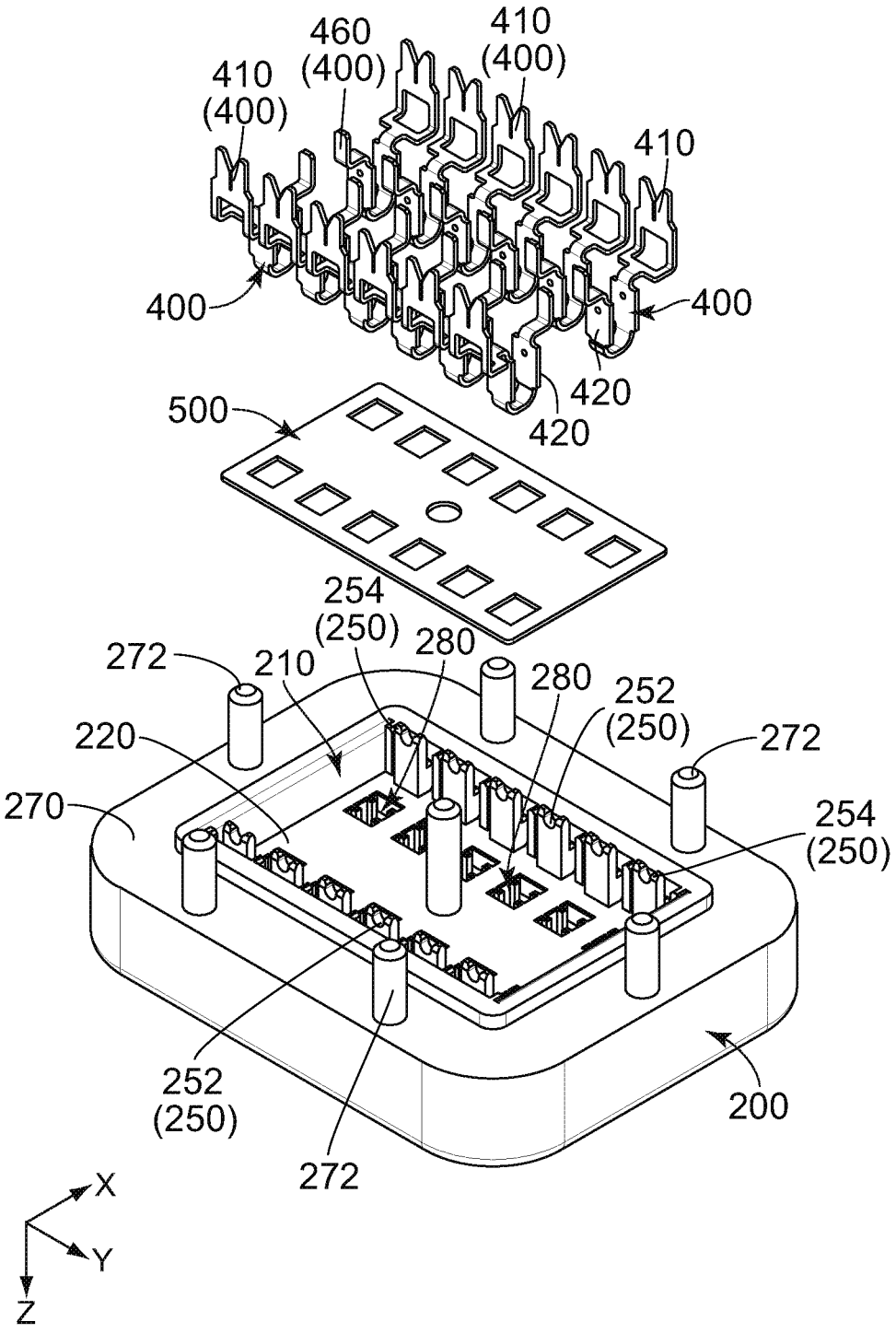
FIG. 8 is an exploded, perspective view showing the structure of FIG. 7.

As shown in FIG. 8, the terminal holding holes 280 of the present embodiment are arranged in two rows in the first predetermined direction. The terminal holding holes 280 of each row are arranged in the second predetermined direction. Each of the terminal holding holes 280 is a hole piercing the housing 200 in the perpendicular direction.

As shown in FIG. 1, the island-like portions 290 of the present embodiment are arranged in two rows in the first predetermined direction. The island-like portions 290 of each row are arranged in the second predetermined direction. Each of the island-like portions 290 protrudes outward in the perpendicular direction. Specifically, each of the island-like portions 290 protrudes upward in the up-down direction from the bottom surface 2052.

As shown in FIG. 8, the housing 200 has a first horizontal portion 220.

As shown in FIG. 8, the first horizontal portion 220 of the present embodiment is perpendicular to the perpendicular direction. The first horizontal portion 220 faces downward in the up-down direction.

As shown in FIG. 8, the housing 200 has a recess portion 210 and an outer peripheral portion 270.

Figure 6:
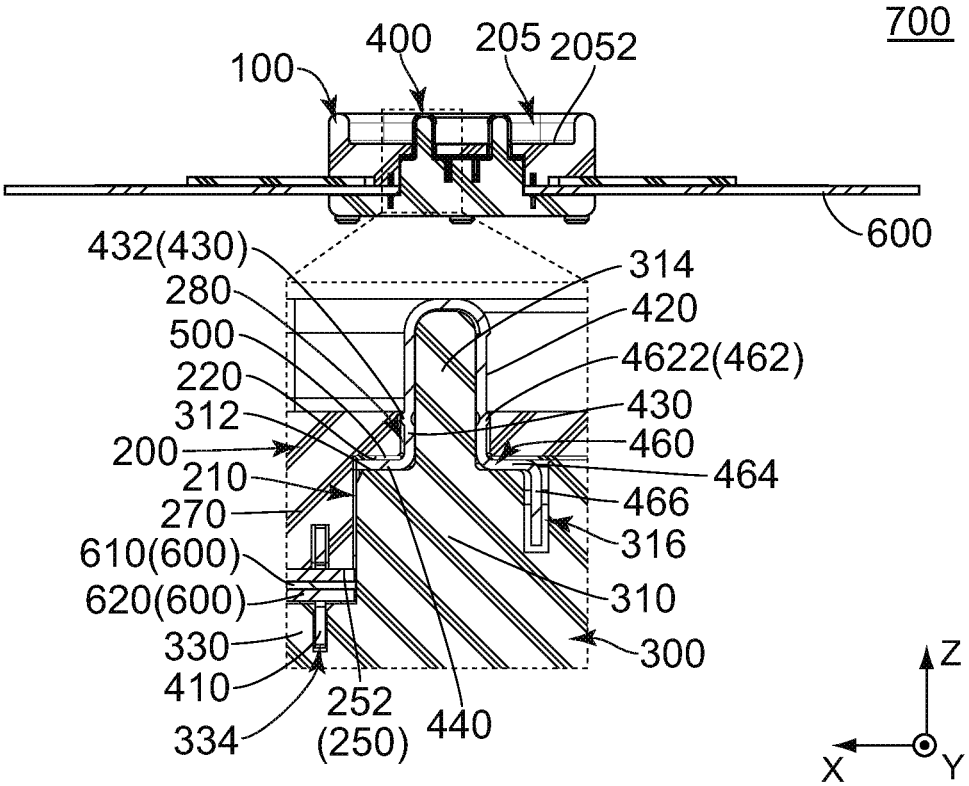
FIG. 6 is a cross-sectional view showing the assembly of FIG. 5, taken along line A-A.

As shown in FIG. 8, the recess portion 210 of the present embodiment is recessed inward in the perpendicular direction. Specifically, the recess portion 210 is recessed upward in the up-down direction. The first horizontal portion 220 is provided in the recess portion 210. The first horizontal portion 220 defines an inner end of the recess portion 210 in the perpendicular direction. Specifically, the first horizontal portion 220 defines an upper end of the recess portion 210 in the up-down direction. Each of the supports 250 is positioned in the recess portion 210. Referring to FIGS. 6 and 8, each of the terminal holding holes 280 connects the recess portion 210 with the mating connector accommodating portion 205 in the perpendicular direction, or in the up-down direction.

As shown in FIG. 8, the outer peripheral portion 270 of the present embodiment is positioned outward beyond the recess portion 210 in a plane which is defined by the first predetermined direction and the second predetermined direction. In other words, the outer peripheral portion 270 is positioned outward beyond the recess portion 210 in a direction perpendicular to the perpendicular direction. The outer peripheral portion 270 defines an outer end of the housing 200 in the plane which is defined by the first predetermined direction and the second predetermined direction. In other words, the outer peripheral portion 270 defines the outer end of the housing 200 in the direction perpendicular to the perpendicular direction. Each of the supports 250 is positioned inward beyond the outer peripheral portion 270 in the plane which is defined by the first predetermined direction and the second predetermined direction. In other words, each of the supports 250 is positioned inward beyond the outer peripheral portion 270 in the direction perpendicular to the perpendicular direction.

As shown in FIG. 8, the outer peripheral portion 270 has a plurality of positioning protrusions 272.

As shown in FIG. 8, each of the positioning protrusions 272 of the present embodiment has a substantially cylindrical shape extending in the perpendicular direction. Each of the positioning protrusions 272 extends downward in the up-down direction.

Referring to FIG. 7, each of the terminals 400 of the present embodiment is made of metal. The terminals 400 correspond to the supports 250, respectively. In addition, the terminals 400 correspond to the terminal holding holes 280, respectively. The terminal 400 is held by the terminal holding hole 280. Specifically, each of the terminals 400 is held by the corresponding terminal holding hole 280. In detail, the terminal 400 is press-fit into the terminal holding hole 280. Specifically, each of the terminals 400 is press-fit into the corresponding terminal holding hole 280. As shown in FIG. 2, the terminals 400 are arranged in two rows in the first predetermined direction. The terminals 400 of each row are arranged in the second predetermined direction. Specifically, the number of the terminals 400 of each row is plural.

Figure 9:
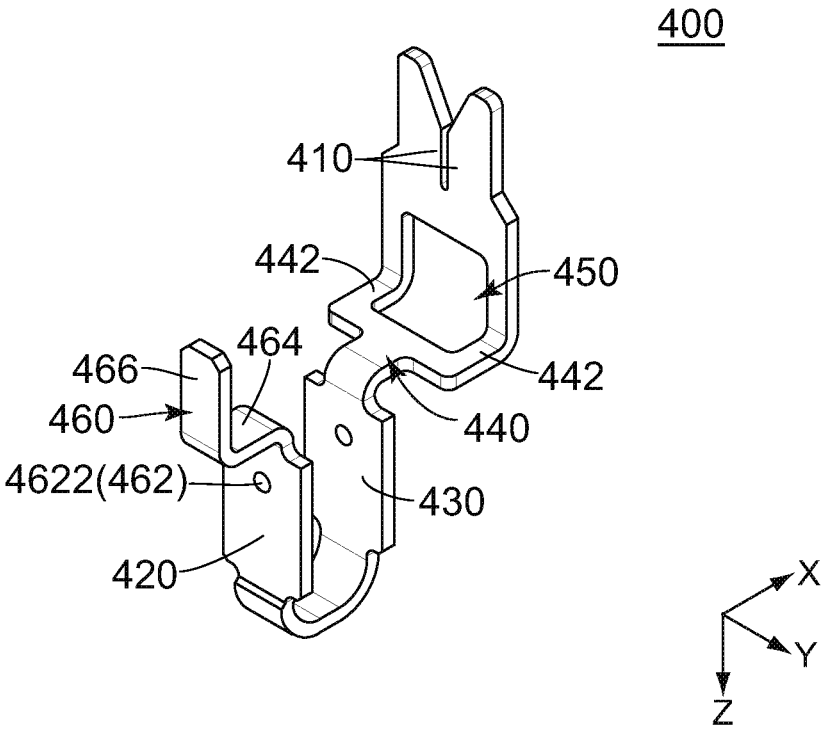
FIG. 9 is a perspective view showing one of terminals of one of rows included in the structure of FIG. 8.

As shown in FIG. 9, each of the terminals 400 has an insulation displacement connection (IDC) portion 410, a contact portion 420, a supporting portion 430, a coupling portion 440 and an extending portion 460.

As shown in FIG. 7, the IDC portion 410 of the present embodiment is configured to be insulation-displacement connected with the electrical wire 600. The electrical wire 600 starts to extend outward in the first predetermined direction from the IDC portion 410. The IDC portion 410 of the terminal 400 is positioned outward in the first predetermined direction beyond the support 250. Specifically, the IDC portion 410 of each of the terminals 400 is positioned outward in the first predetermined direction beyond the corresponding support 250. As shown in FIG. 9, the IDC portion 410 extends outward in the perpendicular direction from the coupling portion 440. Specifically, the IDC portion 410 extends downward in the up-down direction from the coupling portion 440. The IDC portion 410 defines a lower end of the terminal 400 in the up-down direction.

Referring to FIG. 1, the contact portion 420 of the present embodiment is brought into contact with the mating contact portion when the connector 100 is connected with the mating connector. As shown in FIG. 6, the contact portion 420 defines an upper end of the terminal 400 in the up-down direction. The contact portion 420 is curved so as to protrude outward in the perpendicular direction and then extends inward in the perpendicular direction. Specifically, the contact portion 420 is curved so as to protrude upward and then extends downward. However, the contact portion 420 may have any shape.

As shown in FIG. 9, the supporting portion 430 of the present embodiment has a substantially plate-like shape. The supporting portion 430 extends outward in the perpendicular direction from the coupling portion 440. Specifically, the supporting portion 430 extends upward in the up-down direction from the coupling portion 440. The supporting portion 430 supports the contact portion 420. As shown in FIG. 6, the support 250 is positioned between the IDC portion 410 and the supporting portion 430 in the first predetermined direction. Specifically, each of the supports 250 is positioned between the IDC portion 410 and the supporting portion 430 of the corresponding terminal 400 in the first predetermined direction. Accordingly, as compared with the connector 900 of Patent Document 1, mutual positions of the support 250, the IDC portion 410 and the contact portion 420 of the terminal 400 are modified in the connector 100 of the present embodiment.

Figure 18:
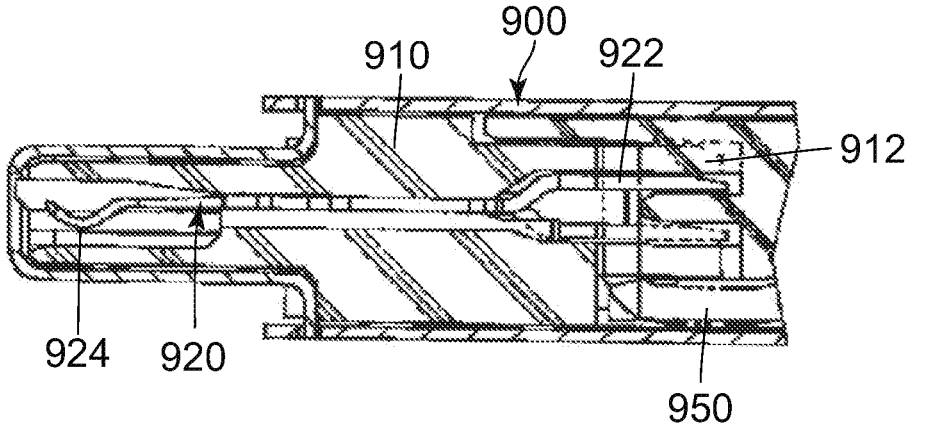
FIG. 18 PRIOR ART
FIG. 18 is a cross-sectional view showing a connector of Patent Document 1.
Figure 19:
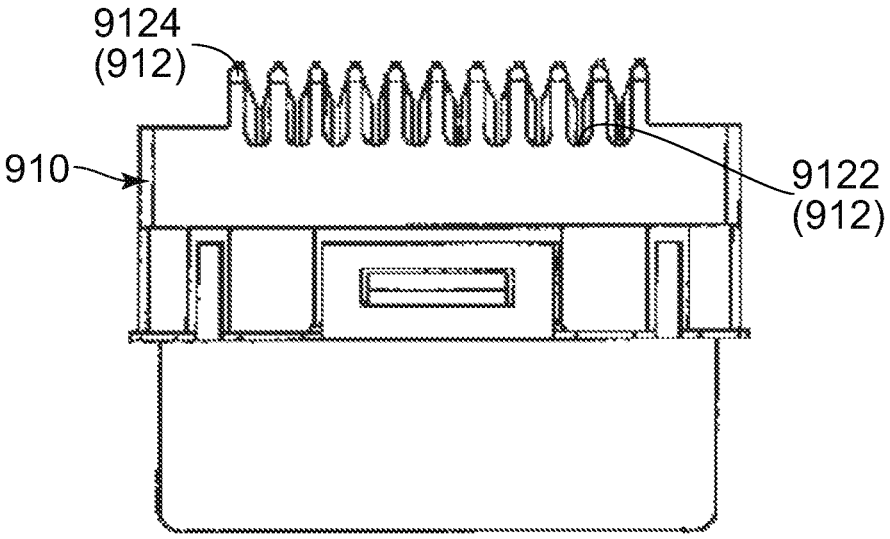
FIG. 19 PRIOR ART
FIG. 19 is a front view showing a structure of the connector of FIG. 18, excluding a cover.
Figure 19:
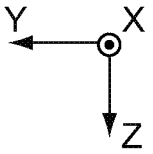
FIG. 19 PRIOR ART

If a connector is formed by using two of the connectors 900 of Patent Document 1 and is configured so that the terminals 920 are arranged in two rows, there are two possible configurations, namely, a first configuration and a second configuration: in the first configuration, a surface, which is illustrated as a positive X-side surface in FIG. 18, of one of the two connectors 900 is attached to a surface, which is illustrated as the positive X-side surface in FIG. 18, of the other one of the two connectors 900; and, in the second configuration, a surface, which is illustrated as a negative X-side surface in FIG. 18, of one of the two connectors 900 is attached to a surface, which is illustrated as the negative X-side surface in FIG. 18, of the other one of the two connectors 900. In the first configuration, the contact portion 924 of one row and the contact portion 924 of the other row are positioned away from each by a distance corresponding to twice a size of the support 912. In the second configuration, the contact portion 924 of one row and the contact portion 924 of the other row are positioned away from each other by a distance corresponding to twice a size of the electrical wire 950. In contrast, as described above, the mutual positions of the support 250, the IDC portion 410 and the contact portion 420 of the terminal 400 are modified in the connector 100 of the present embodiment as compared with the connector 900 of Patent Document 1. This enables the connector 100 of the present embodiment to have a reduced distance between the contact portion 420 of the terminal 400 of one row and the contact portion 420 of the terminal 400 of the other row.

Referring to FIG. 9, a position of the IDC portion 410 in the second predetermined direction overlaps with a position of the supporting portion 430 in the second predetermined direction. More specifically, the position of the IDC portion 410 in the second predetermined direction is same as the position of the supporting portion 430 in the second predetermined direction. As shown in FIG. 6, a part of the supporting portion 430 is positioned in the terminal holding hole 280. The supporting portion 430 has a press-fit protrusion 432. The press-fit protrusion 432 is brought into contact with an inner wall of the terminal holding hole 280 in the first predetermined direction.

As shown in FIG. 9, the coupling portion 440 of the present embodiment is bent from the supporting portion 430 and extends outward in the first predetermined direction. The coupling portion 440 couples the IDC portion 410 and the supporting portion 430 with each other. The coupling portion 440 has two neighboring portions 442.

As shown in FIG. 9, each of the neighboring portions 442 of the present embodiment extends outward in the first predetermined direction. Each of the neighboring portions 442 is positioned away from any of the IDC portion 410 and the contact portion 420 in the perpendicular direction perpendicular to both the first predetermined direction and the second predetermined direction. Each of the neighboring portions 442 is positioned between the IDC portion 410 and the supporting portion 430 in the perpendicular direction. Each of the neighboring portions 442 is positioned between the IDC portion 410 and the supporting portion 430 in the first predetermined direction. Each of the neighboring portions 442 is positioned outward in the second predetermined direction beyond the contact portion 420. Each of the neighboring portions 442 is positioned outward in the second predetermined direction beyond the IDC portion 410. As shown in FIG. 7, each of the neighboring portions 442 neighbors to the support 250 in the second predetermined direction perpendicular to the first predetermined direction. Specifically, each of the neighboring portions 442 of the terminal 400 neighbors to the corresponding support 250 in the second predetermined direction. Each of the supports 250 is positioned between the two neighboring portions 442 of the corresponding terminal 400 in the second predetermined direction.

As shown in FIG. 9, the extending portion 460 of the present embodiment extends from the contact portion 420. The extending portion 460 has a first portion 462, a second portion 464 and a third portion 466.

As shown in FIG. 9, the first portion 462 of the present embodiment extends inward in the perpendicular direction from the contact portion 420. Specifically, the first portion 462 extends downward in the up-down direction from the contact portion 420. The first portion 462 couples the contact portion 420 and the second portion 464 with each other. The first portion 462 has a press-fit protrusion 4622. As shown in FIG. 6, the press-fit protrusion 4622 is brought into contact with the inner wall of the terminal holding hole 280 in the first predetermined direction.

As shown in FIG. 9, the second portion 464 of the present embodiment is bent from the first portion 462 and extends inward in the first predetermined direction. The second portion 464 couples the first portion 462 and the third portion 466 with each other.

As shown in FIG. 9, the third portion 466 of the present embodiment is bent from the second portion 464 and extends in the perpendicular direction. Specifically, the third portion 466 is bent from the second portion 464 and extends downward in the up-down direction. The third portion 466 defines an inner end of the terminal 400 in the first predetermined direction.

As shown in FIG. 9, each of the terminals 400 of the present embodiment is formed with a hole 450.

As shown in FIG. 9, the hole 450 of the present embodiment is positioned above the IDC portion 410 in the up-down direction. The hole 450 is positioned between the IDC portion 410 and the supporting portion 430 in the first predetermined direction. As shown in FIG. 7, the support 250 passes through the hole 450. Specifically, each of the supports 250 passes through the hole 450 of the corresponding terminal 400.

As shown in FIG. 6, the connector 100 further comprises an additional housing 300.

As shown in FIG. 6, the additional housing 300 of the present embodiment is combined with the housing 200 in the perpendicular direction, or in the up-down direction. The additional housing 300 has a second horizontal portion 312.

Referring to FIG. 6, the second horizontal portion 312 of the present embodiment is perpendicular to the perpendicular direction. The second horizontal portion 312 faces upward in the up-down direction. As understood from FIGS. 6 and 7, the neighboring portion 442 is positioned between the first horizontal portion 220 and the second horizontal portion 312 in the perpendicular direction. The guide surface 254 faces the additional housing 300 in the first predetermined direction.

As shown in FIG. 6, the additional housing 300 has a protruding portion 310 and a flange portion 330.

As shown in FIG. 6, the protruding portion 310 of the present embodiment protrudes upward in the up-down direction from the flange portion 330. The second horizontal portion 312 is provided on the protruding portion 310. The protruding portion 310 faces the guide surface 254 of the support 250 in the first predetermined direction.

As shown in FIG. 6, the protruding portion 310 has a plurality of protrusions 314 and a plurality of third portion accommodating portions 316.

Referring to FIG. 6, the protrusions 314 of the present embodiment are arranged in two rows in the first predetermined direction. The protrusions 314 of each row are arranged in the second predetermined direction. Each of the protrusions 314 protrudes upward in the up-down direction from the second horizontal portion 312. The protrusions 314 correspond to the terminals 400, respectively. The protrusion 314 faces the supporting portion 430 of the terminal 400 in the first predetermined direction. More specifically, each of the protrusions 314 faces the supporting portion 430 of the corresponding terminal 400 in the first predetermined direction. The protrusion 314 faces the first portion 462 of the terminal 400 in the first predetermined direction. More specifically, each of the protrusions 314 faces the first portion 462 of the corresponding terminal 400 in the first predetermined direction.

As shown in FIG. 6, each of the third portion accommodating portions 316 of the present embodiment is a recess which is recessed downward in the up-down direction. Each of the third portion accommodating portions 316 opens at its upper end in the up-down direction. Each of the third portion accommodating portions 316 is positioned below the second horizontal portion 312 in the up-down direction. Each of the third portion accommodating portions 316 is positioned below any of the protrusions 314 in the up-down direction. Each of the third portion accommodating portions 316 is positioned inward beyond the flange portion 330 in the plane which is defined by the first predetermined direction and the second predetermined direction. In other words, each of the third portion accommodating portions 316 is positioned inward beyond the flange portion 330 in the direction perpendicular to the perpendicular direction. The third portion accommodating portions 316 correspond to the terminals 400, respectively. The third portion accommodating portion 316 accommodates the third portion 466 of the terminal 400. Specifically, each of the third portion accommodating portions 316 accommodates the third portion 466 of the corresponding terminal 400.

Referring to FIG. 6, the flange portion 330 of the present embodiment is positioned outward beyond the protruding portion 310 in the plane which is defined by the first predetermined direction and the second predetermined direction. In other words, the flange portion 330 is positioned outward beyond the protruding portion 310 in the direction perpendicular to the perpendicular direction. The flange portion 330 defines an outer end of the additional housing 300 in the plane which is defined by the first predetermined direction and the second predetermined direction. In other words, the flange portion 330 defines the outer end of the additional housing 300 in the direction perpendicular to the perpendicular direction. The second horizontal portion 312 is positioned inward beyond the flange portion 330 in the plane which is defined by the first predetermined direction and the second predetermined direction. In other words, the second horizontal portion 312 is positioned inward beyond the flange portion 330 in the direction perpendicular to the perpendicular direction. The second horizontal portion 312 is positioned above the flange portion 330 in the up-down direction. Each of the protrusions 314 is positioned inward beyond the flange portion 330 in the plane which is defined by the first predetermined direction and the second predetermined direction. In other words, each of the protrusions 314 is positioned inward beyond the flange portion 330 in the direction perpendicular to the perpendicular direction. Each of the protrusions 314 is positioned above the flange portion 330 in the up-down direction. In the assembly 700, each of the electrical wires 600 is partially sandwiched by the outer peripheral portion 270 and the flange portion 330.

Figure 3:
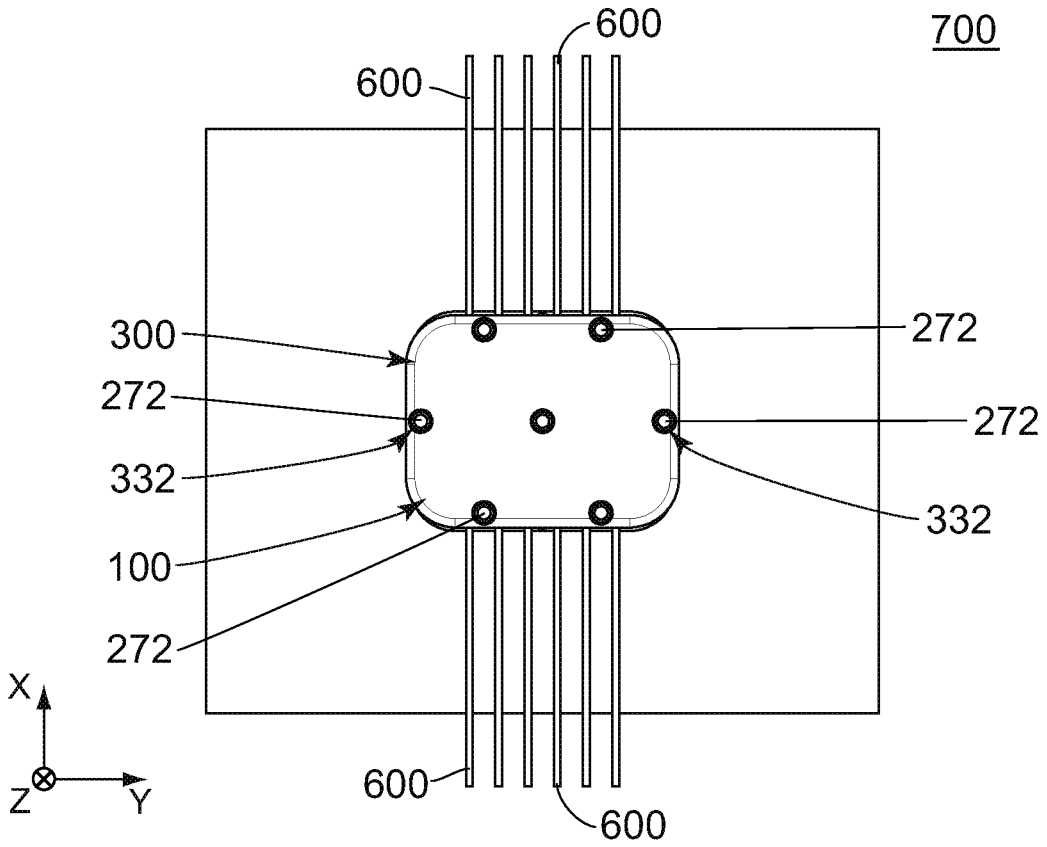
FIG. 3 is a bottom view showing the assembly of FIG. 1.
Figure 4:
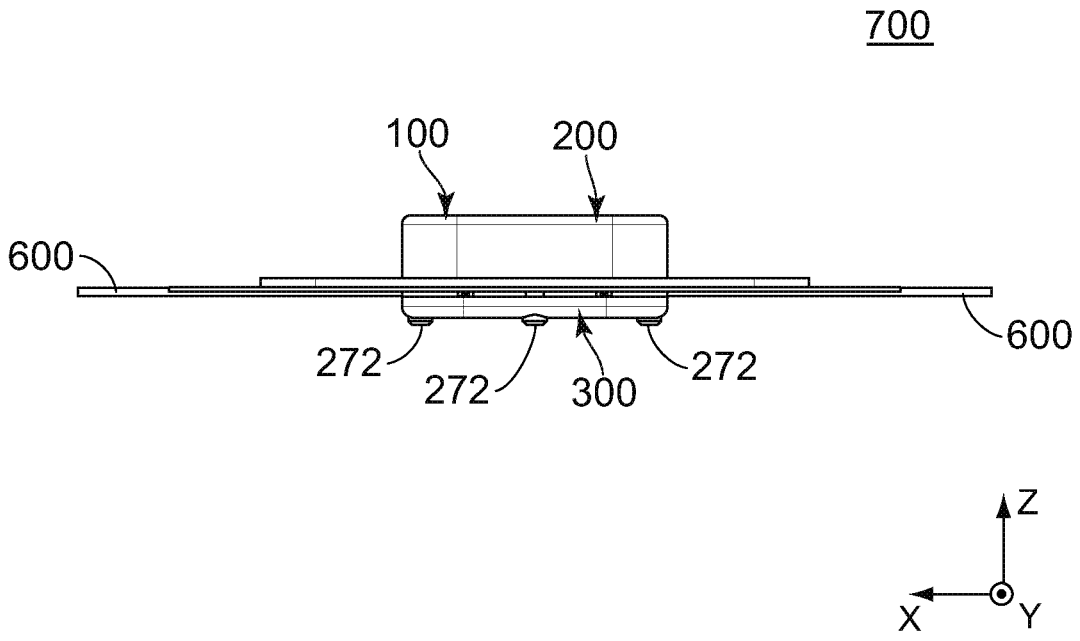
FIG. 4 is a side view showing the assembly of FIG. 1.
Figure 5:
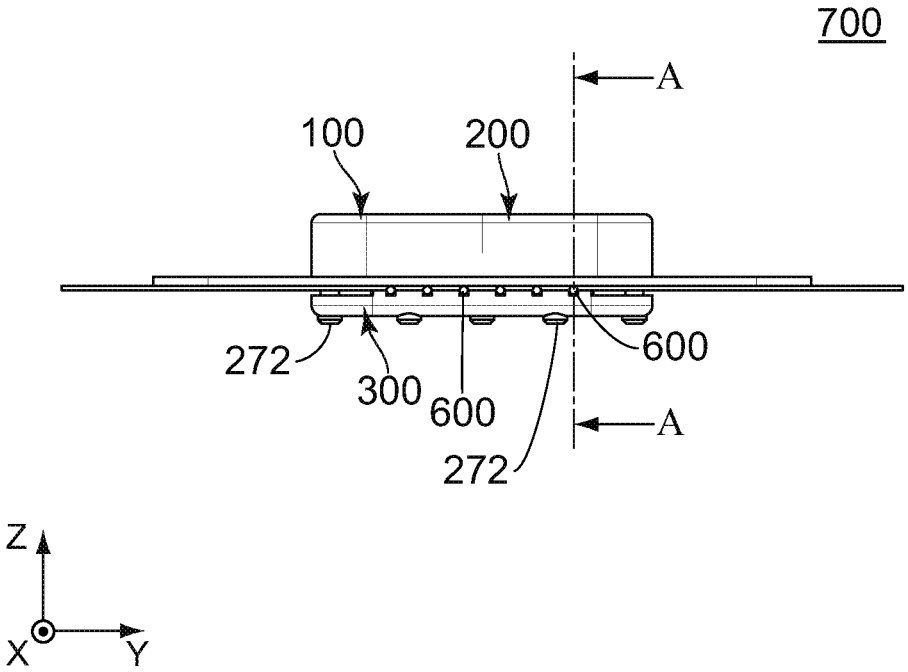
FIG. 5 is a front view showing the assembly of FIG. 1.

Referring to FIGS. 3 and 6, the flange portion 330 has a plurality of positioning holes 332 and a plurality of IDC portion accommodating portions 334.

Referring to FIG. 3, each of the positioning holes 332 of the present embodiment is a hole piercing the flange portion 330 in the perpendicular direction, or in the up-down direction. The positioning holes 332 correspond to the positioning protrusions 272, respectively. The positioning hole 332 accommodates the positioning protrusion 272. Specifically, each of the positioning holes 332 accommodates the corresponding positioning protrusion 272.

Referring to FIG. 6, each of the IDC portion accommodating portions 334 of the present embodiment is a recess which is recessed outward in the perpendicular direction. Specifically, each of the IDC portion accommodating portions 334 is recessed downward in the up-down direction. Each of the IDC portion accommodating portions 334 opens at its upper end in the up-down direction. Each of the IDC portion accommodating portions 334 is positioned outward beyond the protruding portion 310 in the plane which is defined by the first predetermined direction and the second predetermined direction. In other words, each of the IDC portion accommodating portions 334 is positioned outward beyond the protruding portion 310 in the direction perpendicular to the perpendicular direction. Each of the IDC portion accommodating portions 334 is positioned below the protruding portion 310 in the up-down direction. Each of the IDC portion accommodating portions 334 is positioned below the second horizontal portion 312 in the up-down direction. The IDC portion accommodating portions 334 correspond to the terminals 400, respectively. The IDC portion accommodating portion 334 accommodates a part of the IDC portion 410 of the terminal 400. Specifically, each of the IDC portion accommodating portions 334 accommodates the part of the IDC portion 410 of the corresponding terminal 400.

As shown in FIG. 8, the connector 100 further comprises a waterproofing member 500.

Referring to FIG. 8, the waterproofing member 500 of the present embodiment is made of resin. As shown in FIG. 6, the waterproofing member 500 is sandwiched between the first horizontal portion 220 and the second horizontal portion 312 in the perpendicular direction, or in the up-down direction. This enables a space in the recess portion 210 to be waterproofed.

Hereinafter, a detailed description will be made about an example of a fabrication method of the assembly 700.

Figure 10:
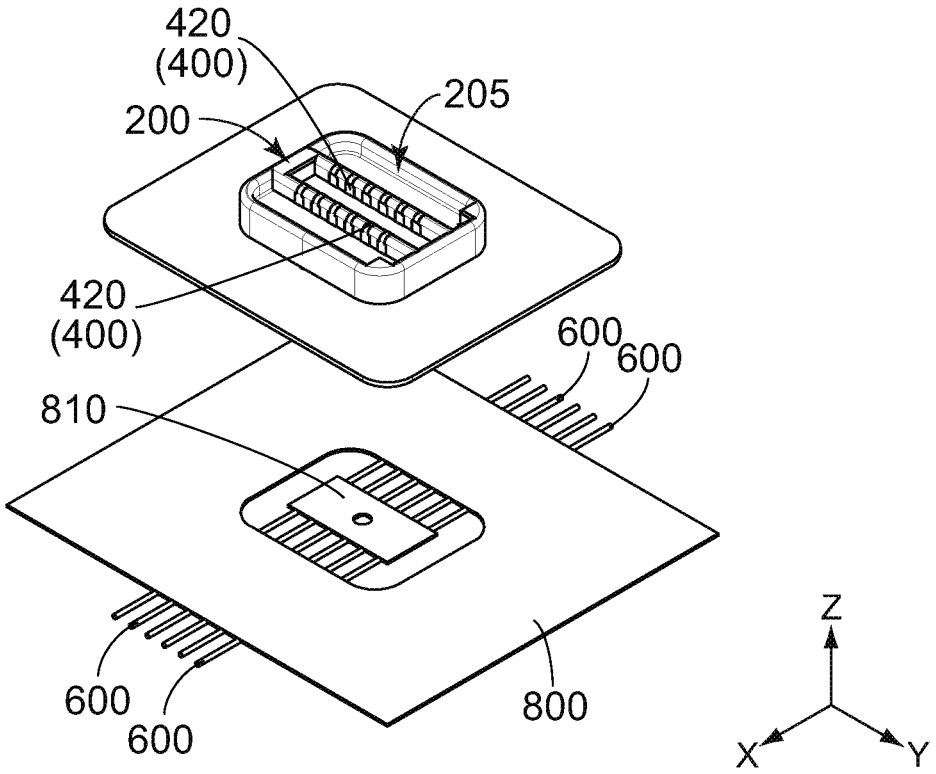
FIG. 10 is a perspective view for explaining a method of manufacturing the assembly of FIG. 1. In the figure, none of electrical wires are attached to any of the terminals.
Figure 11:
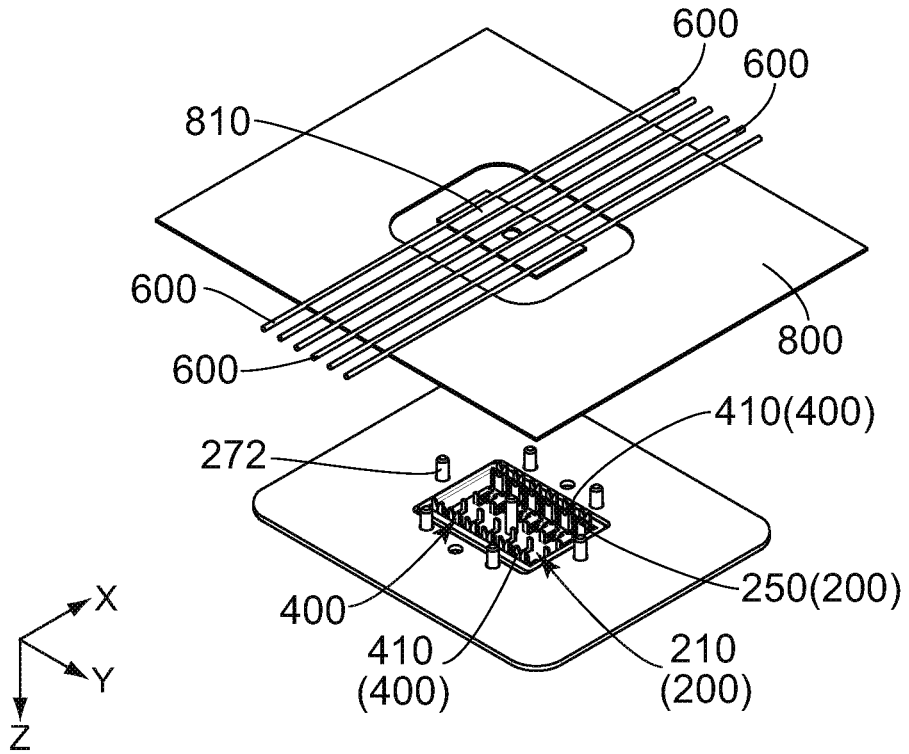
FIG. 11 is another perspective view for explaining the method of manufacturing the assembly of FIG. 1. In the figure, none of the electrical wires are attached to any of the terminals.

First, referring to FIGS. 10 and 11, the electrical wires 600, which are adhered to both of a substrate 800 and an additional substrate 810, are arranged below the connector 100.

Figure 12:
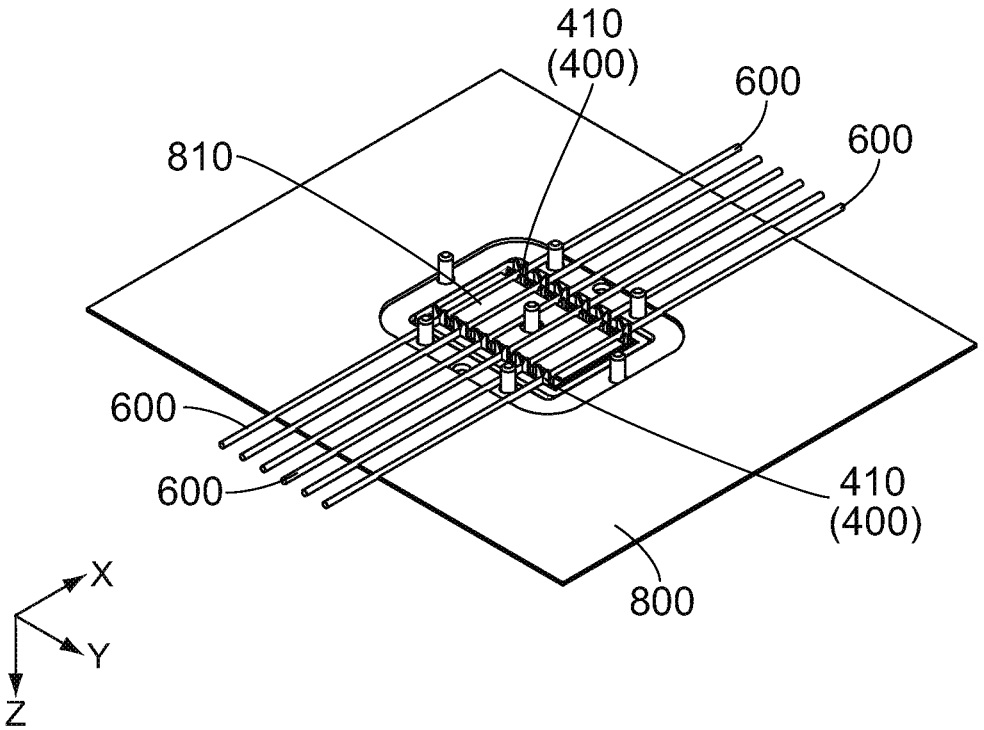
FIG. 12 is yet another perspective view for explaining the method of manufacturing the assembly of FIG. 1. In the figure, the electrical wires are attached to the terminals.

Next, the electrical wires 600 are pushed into the IDC portions 410 of the terminals 400 of the connector 100 from below. Then, the core wires 610 of the electrical wires 600 are insulation-displacement connected with the IDC portions 410 while the outer covers 620 of the electrical wires 600 are broken by the IDC portions 410. Thus, the connector 100 and the electrical wires 600 become in a state shown in FIG. 12. In this state, each of the electrical wires 600 extends across the connector 100 in the first predetermine direction and is insulation-displacement connected with the IDC portions 410 of two of the terminals 400 which are positioned away from each other in the first predetermined direction.

After that, a jig 850, which has two blades 852 arranged in the first predetermined direction, is arranged so that each of the blades 852 is brought into contact with the electrical wires 600 while being positioned inward beyond any of the supports 250 in the first predetermined direction. However, it may occur that the blade 852 of the jig 850 is brought into contact with the guide surface 254 of the support 250 upon the aforementioned arrangement. As described above, the guide surface 254 is inclined outward in the perpendicular direction and outward in the first predetermined direction. Thus, when the jig 850 is moved to approach the connector 100 in the perpendicular direction in this case, the blade 852, which is in contact with the guide surface 254, is moved inward in the first predetermined direction along the guide surface 254 and is then brought into contact with the electrical wire 600.

Figure 13:
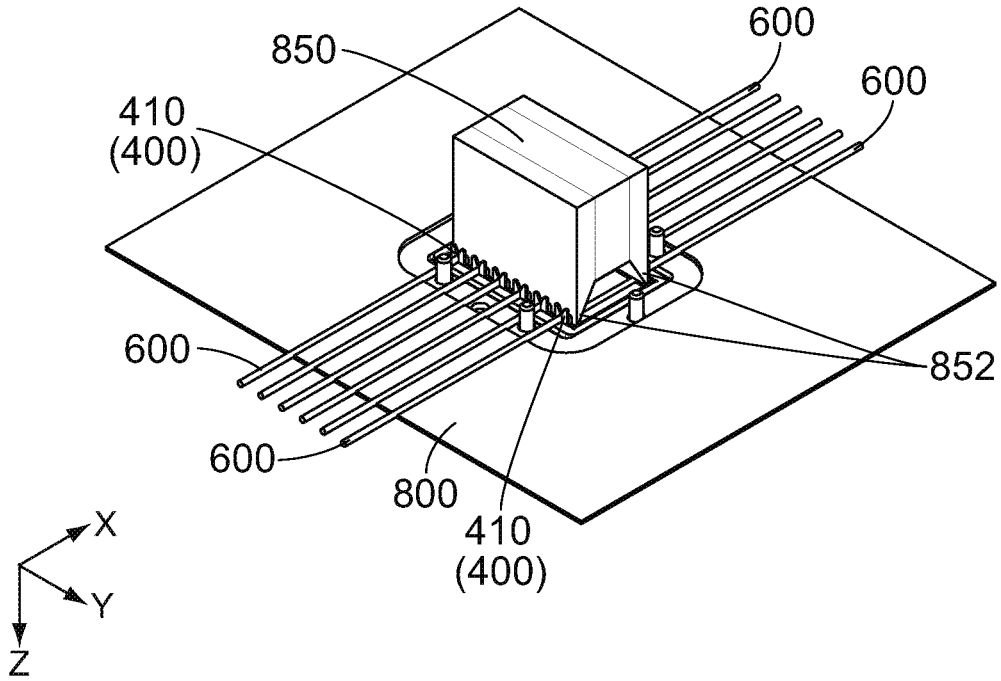
FIG. 13 is still another perspective view for explaining the method of manufacturing the assembly of FIG. 1. In the figure, the electrical wires are attached to the terminals while all of the electrical wires are cut by a jig.
Figure 14:
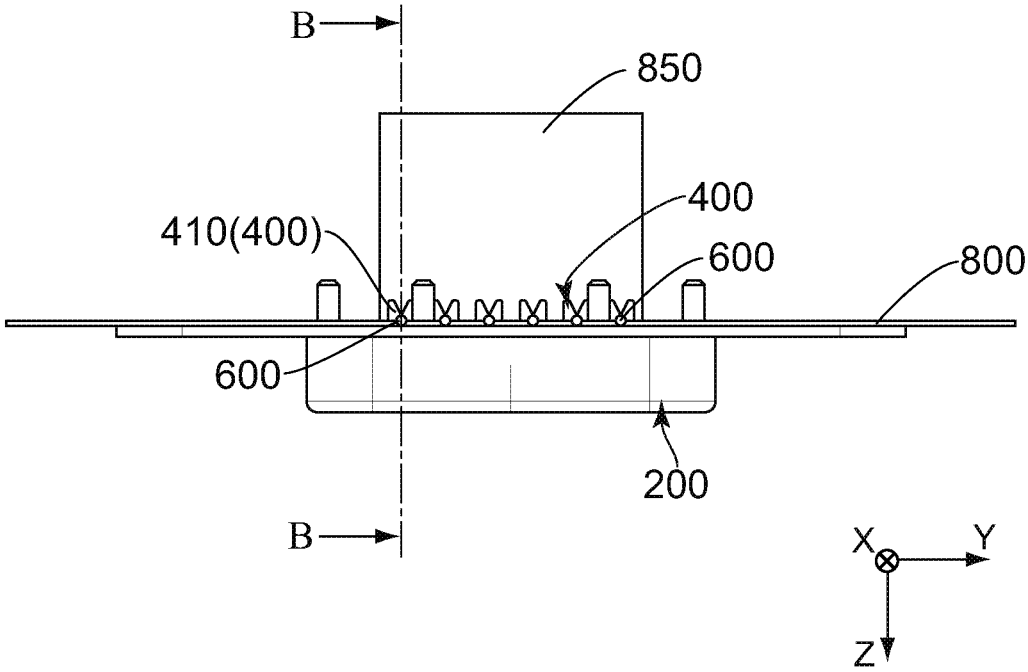
FIG. 14 is a front view for explaining the method of manufacturing the assembly of FIG. 1. In the figure, the electrical wires are attached to the terminals while all of the electrical wires are cut by the jig.
Figure 15:
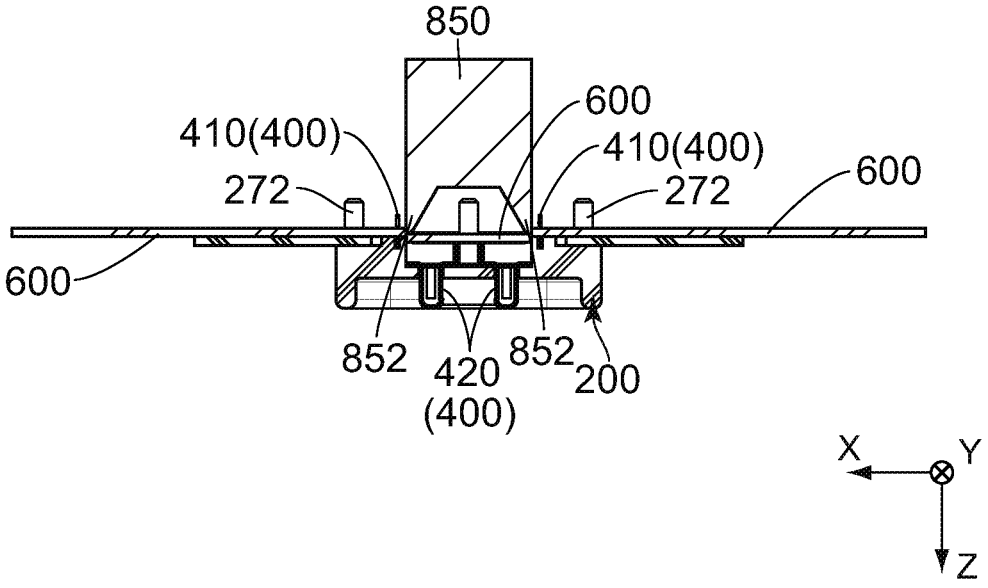
FIG. 15 is a cross-sectional view showing the assembly of FIG. 14, taken along line B-B.
Figure 16:
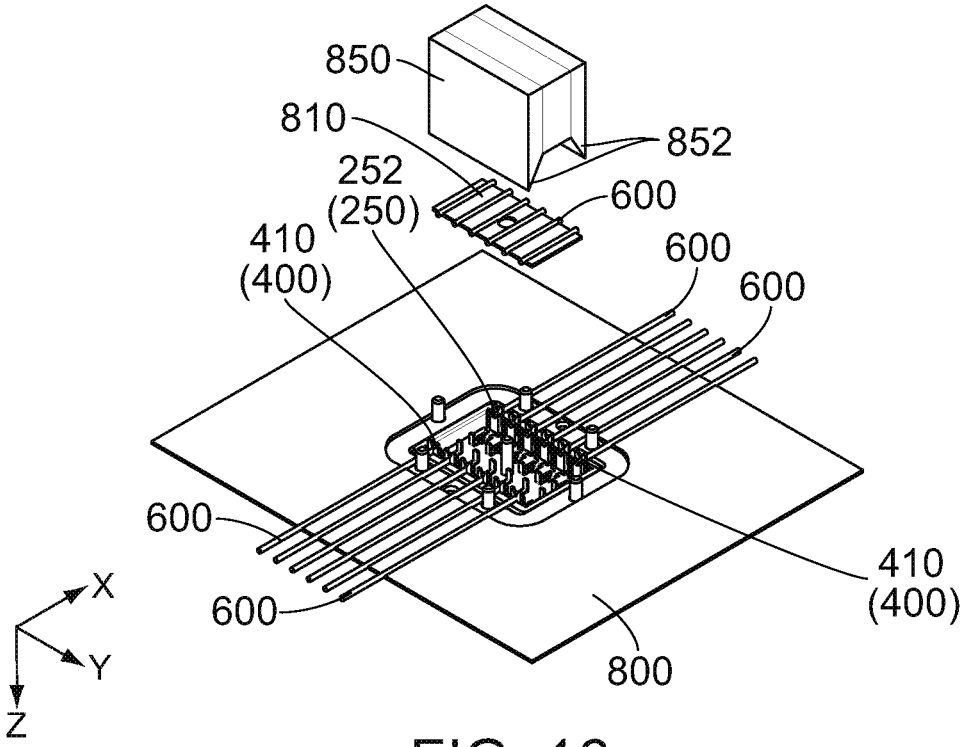
FIG. 16 is still yet another perspective view for explaining the method of manufacturing the assembly of FIG. 1. In the figure, the electrical wires are attached to the terminals while a part of each of the electrical wires is removed.

In this state, the jig 850 is pressed against the electrical wires 600 so as to approach the connector 100 in the perpendicular direction. Then, a part of each of the electrical wires 600 is cut off. Thus, the connector 100 and the electrical wires 600 change their state into a state shown in each of FIGS. 13 to 15. After that, the cut-off part of each of the electrical wires 600, which is positioned between the IDC portions 410 of the two terminals 400, is removed from a remaining part thereof together with the additional substrate 810. Then, the connector 100 and the electrical wires 600 change their state into a state shown in FIG. 16.

Figure 17:
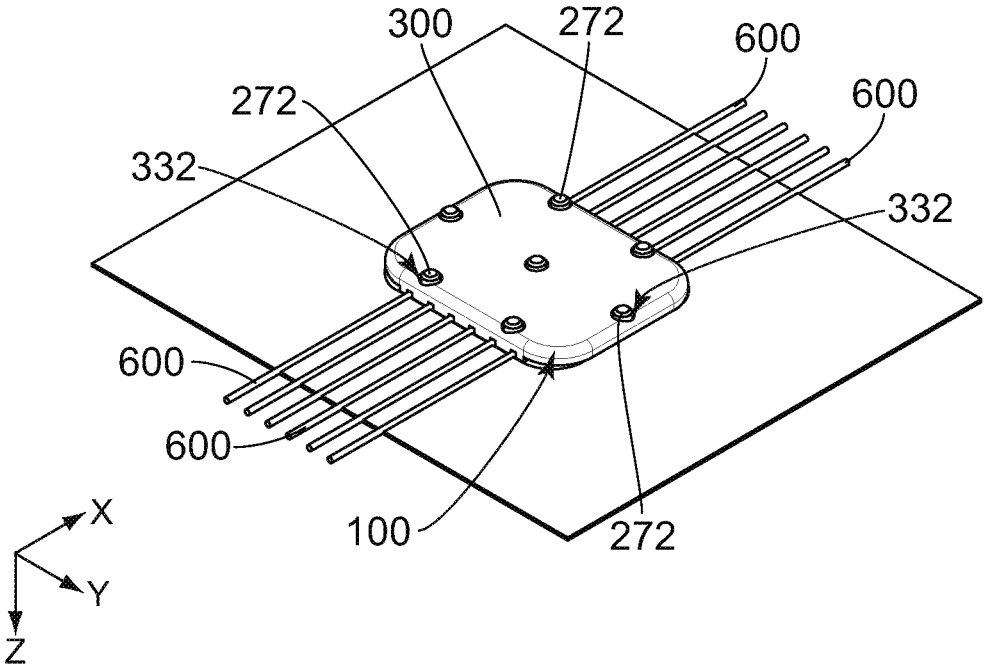
FIG. 17 is still yet another perspective view for explaining the method of manufacturing the assembly of FIG. 1. In the figure, a housing is combined with the additional housing.

Finally, the additional housing 300 is combined with the housing 200 in the perpendicular direction so that each of the positioning protrusions 272 of the housing 200 is inserted into the corresponding positioning hole 332 of the additional housing 300, and each of the positioning protrusions 272 is welded to the corresponding positioning hole 332 by heating and pressing a lower end of each of the positioning protrusions 272. Thus, the connector 100 and the electrical wires 600 become in a state shown in FIG. 17, and the fabrication of the assembly 700 is completed.

In the aforementioned fabrication method, each of the electrical wires 600, which extends across the connector 100, is insulation-displacement connected with the IDC portions 410 of the two terminals 400, and the part of the electrical wire 600 between the IDC portions 410 thereof is cut off and removed from the remaining part thereof. Thus, two circuits of the assembly 700 are simultaneously fabricated by using the single electrical wire 600. This reduces labor of the fabrication of the assembly 700.

Although the specific explanation about the present invention is made above referring to the embodiments, the present invention is not limited thereto and is susceptible to various modifications and alternative forms. In addition, the above embodiments and variations may also be combined.

Although the connector 100 of the aforementioned embodiment is configured so that the number of the terminals 400 of each row is plural, the present invention is not limited thereto. Specifically, the number of the terminal 400 of each row may be one. In other words, the connector 100 may be modified to have two of the terminals 400 which are positioned away from each other in the first predetermined direction. Similar to the aforementioned embodiment, mutual positions of the support 250, the IDC portion 410 and the contact portion 420 of the terminal 400 are modified also in the connector 100 of the present modification as compared with the connector 900 of Patent Document 1. This enables also the connector 100 of the present modification to have a reduced distance between the contact portions 420 of the two terminals 400. In addition, an assembly 700 comprising the connector 100 of the present modification can be fabricated in a manner similar to that of the aforementioned embodiment. Thus, two circuits of the assembly 700 of the present modification are simultaneously fabricated by using the single electrical wire 600. This reduces labor of the fabrication of the assembly 700 of the present modification.

Although the housing 200 of the aforementioned embodiment is provided with the plurality of supports 250, the present invention is not limited thereto. Specifically, the connector 100 may be modified so that the housing 200 is provided with two of the supports 250 which correspond to the aforementioned two terminals 400, respectively, which are positioned away from each other in the first predetermined direction. If the connector 100 of the present modification is configured, similar to the aforementioned embodiment, so that the terminals 400 correspond to the supports 250, respectively, and the IDC portion 410 of each of the terminals 400 is positioned outward in the first predetermined direction beyond the corresponding support 250, the connector 100 of the present modification can have a further reduced distance between the contact portions 420 of the two terminals 400.

Although the terminal 400 of the aforementioned embodiment has the extending portion 460, the present invention is not limited thereto. Specifically, the terminal 400 may have no extending portion 460.

Although the terminal 400 of the aforementioned embodiment has the hole 450 and the two neighboring portions 442, the present invention is not limited thereto. Specifically, the number of the neighboring portion 442 may be one. In other words, the coupling portion 440 should have the single neighboring portion 442. More specifically, the terminal 400 may be modified so that the IDC portion 410 and the supporting portion 430 are coupled with each other via the single neighboring portion 442.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector with which an electrical wire is attachable, the connector being connectable with a mating connector which has a mating contact portion, wherein:

the connector comprises a housing and at least one terminal;

the housing holds the at least one terminal;

the housing is provided with a support;

the support has a receiving portion;

the receiving portion is configured to receive a part of the electrical wire;

the at least one terminal has an insulation displacement connection (IDC) portion, a contact portion, a supporting portion and a coupling portion;

the IDC portion is configured to be insulation-displacement connected with the electrical wire;

the contact portion is brought into contact with the mating contact portion when the connector is connected with the mating connector;

the supporting portion supports the contact portion;

the support is positioned between the IDC portion and the supporting portion in a first predetermined direction;

the coupling portion couples the IDC portion and the supporting portion with each other;

the coupling portion has a neighboring portion; and the neighboring portion neighbors to the support in a second predetermined direction perpendicular to the first predetermined direction.

2. The connector as recited in claim 1, wherein:

a position of the IDC portion in the second predetermined direction overlaps with a position of the supporting portion in the second predetermined direction;

the terminal is formed with a hole;

the hole is positioned between the IDC portion and the supporting portion in the first predetermined direction; and the support passes through the hole.

3. The connector as recited in claim 1, wherein:

the at least one terminal includes two of the terminals; and the two terminals are positioned away from each other in the first predetermined direction.

4. The connector as recited in claim 2, wherein:

the housing is provided with two of the supports;

the terminals correspond to the supports, respectively; and the IDC portion of each of the terminals is positioned outward in the first predetermined direction beyond the corresponding support.

5. The connector as recited in claim 1, wherein the neighboring portion is positioned away from any of the IDC portion and the contact portion in a perpendicular direction perpendicular to both the first predetermined direction and the second predetermined direction.

6. The connector as recited in claim 5, wherein the neighboring portion is positioned between the IDC portion and the supporting portion in the perpendicular direction.

7. The connector as recited in claim 5, wherein the perpendicular direction is a direction in which the connector is connected with the mating connector.

8. The connector as recited in claim 5, wherein:

the housing has a first horizontal portion;

the connector further comprises an additional housing;

the additional housing is combined with the housing in the perpendicular direction;

the additional housing has a second horizontal portion; and the neighboring portion is positioned between the first horizontal portion and the second horizontal portion in the perpendicular direction.

9. The connector as recited in claim 8, wherein:

the connector further comprises a waterproofing member; and the waterproofing member is sandwiched between the first horizontal portion and the second horizontal portion in the perpendicular direction.

10. The connector as recited in claim 8, wherein:

the support further has a guide surface;

the guide surface intersects with the first predetermined direction; and the guide surface faces the additional housing in the first predetermined direction.

11. The connector as recited in claim 8, wherein:

the housing further has a recess portion and an outer peripheral portion;

the first horizontal portion is provided in the recess portion;

the outer peripheral portion is positioned outward beyond the recess portion in a plane which is defined by the first predetermined direction and the second predetermined direction;

the additional housing further has a protruding portion and a flange portion; and the second horizontal portion is provided on the protruding portion.

12. An assembly comprising the connector and the electrical wire;

the connector with which an electrical wire is attachable, the connector being connectable with a mating connector which has a mating contact portion, wherein: the connector comprises a housing and at least one terminal; the housing holds the at least one terminal; the housing is provided with a support; the support has a receiving portion; the receiving portion is configured to receive a part of the electrical wire; the at least one terminal has an insulation displacement connection (IDC) portion, a contact portion, a supporting portion and a coupling portion; the IDC portion is configured to be insulation-displacement connected with the electrical wire; the contact portion is brought into contact with the mating contact portion when the connector is connected with the mating connector; the supporting portion supports the contact portion; the support is positioned between the IDC portion and the supporting portion in a first predetermined direction; the coupling portion couples the IDC portion and the supporting portion with each other; the coupling portion has a neighboring portion; and the neighboring portion neighbors to the support in a second predetermined direction perpendicular to the first predetermined direction.

13. An assembly comprising the connector and the electrical wire, the connector with which an electrical wire is attachable, the connector being connectable with a mating connector which has a mating contact portion, wherein: the connector comprises a housing and at least one terminal; the housing holds the at least one terminal; the housing is provided with a support; the support has a receiving portion; the receiving portion is configured to receive a part of the electrical wire; the at least one terminal has an insulation displacement connection (IDC) portion, a contact portion, a supporting portion and a coupling portion; the IDC portion is configured to be insulation-displacement connected with the electrical wire; the contact portion is brought into contact with the mating contact portion when the connector is connected with the mating connector; the supporting portion supports the contact portion; the support is positioned between the IDC portion and the supporting portion in a first predetermined direction; the coupling portion couples the IDC portion and the supporting portion with each other; the coupling portion has a neighboring portion; and the neighboring portion neighbors to the support in a second predetermined direction perpendicular to the first predetermined direction;

wherein the neighboring portion is positioned away from any of the IDC portion and the contact portion in a perpendicular direction perpendicular to both the first predetermined direction and the second predetermined direction;

wherein the housing has a first horizontal portion; the connector further comprises an additional housing; the additional housing is combined with the housing in the perpendicular direction; the additional housing has a second horizontal portion; and the neighboring portion is positioned between the first horizontal portion and the second horizontal portion in the perpendicular direction;

wherein the housing further has a recess portion and an outer peripheral portion; the first horizontal portion is provided in the recess portion; the outer peripheral portion is positioned outward beyond the recess portion in a plane which is defined by the first predetermined direction and the second 15 predetermined direction; the additional housing further has a protruding portion and a flange portion; and the second horizontal portion is provided on the protruding portion;

wherein the electrical wire is partially sandwiched by the outer peripheral portion and the flange portion.

* * * * *